US007344168B2

(12) United States Patent
Matsubara et al.

(10) Patent No.: US 7,344,168 B2
(45) Date of Patent: Mar. 18, 2008

(54) DOOR HANDLE DEVICE FOR VEHICLES

(75) Inventors: Masayoshi Matsubara, Hiroshima (JP); Tsuyoshi Muneta, Hiroshima (JP)

(73) Assignee: U-Shin Ltd., Tokyo (JP)

( * ) Notice: Subject to any disclaimer, the term of this patent is extended or adjusted under 35 U.S.C. 154(b) by 29 days.

(21) Appl. No.: 11/244,220

(22) Filed: Oct. 6, 2005

(65) Prior Publication Data

US 2006/0082167 A1 Apr. 20, 2006

(30) Foreign Application Priority Data

Oct. 14, 2004 (JP) ..... 2004-299778
Oct. 14, 2004 (JP) ..... 2004-299779

(51) Int. Cl.
*E05B 3/00* (2006.01)

(52) U.S. Cl. ..... 292/336.3; 292/DIG. 53; 411/999; 411/112

(58) Field of Classification Search ..... 292/336.3, 292/348, 350, DIG. 53, DIG. 64; 411/999, 411/85, 111, 112
See application file for complete search history.

(56) References Cited

U.S. PATENT DOCUMENTS 2,404,845 A * 7/1946 Joachim ..... 292/336.3
3,315,721 A * 4/1967 Koehl ..... 411/173
5,170,013 A * 12/1992 Borsh et al. ..... 174/53
5,290,132 A * 3/1994 Gnage et al. ..... 411/512
5,340,174 A * 8/1994 Bender et al. ..... 292/336.3
5,860,684 A * 1/1999 Mizuki ..... 292/336.3
5,951,223 A * 9/1999 Lindquist ..... 411/175
6,039,366 A * 3/2000 Lewis ..... 292/352
6,692,206 B1 * 2/2004 Clinch et al. ..... 411/171
6,719,336 B2 * 4/2004 Sato ..... 292/336.3
7,223,458 B2 * 5/2007 Tango ..... 428/131

FOREIGN PATENT DOCUMENTS

JP 2004-76395 3/2004

* cited by examiner

*Primary Examiner*—Gary Estremsky
(74) *Attorney, Agent, or Firm*—Wenderoth, Lind & Ponack, L.L.P.

(57) ABSTRACT

A door handle device for vehicles is capable of preventing falling of the screw locking member and the screw and improving the assembling workability. In the door handle device (1) for vehicles including a handle base (3) to be fixed to a door panel (5) by screwing, the handle base (3) has a through hole (18) for inserting a screw (6) thereinto, and a screw locking member (14) into which a fore end of the screw (6) inserted into the through hole (18) is to be screwed, the screw locking member (14) being formed integrally with the handle base (3) so that the screw locking member (14) can be moved to a position corresponding to the through hole (18).

11 Claims, 4 Drawing Sheets

DOOR HANDLE DEVICE FOR VEHICLES

BACKGROUND OF THE INVENTION

The present invention relates to a door handle device for vehicles.

There has conventionally been provided a door handle device for vehicles which device is so designed that door opening operation is performed by operating a handle member provided on the vehicle outside of a door panel of the vehicle. This type of door handle device commonly has a handle base to which the handle member is rotatably mounted and fixed, the handle base being fixed to the door panel of the vehicle by screwing.

As to the structure for assembling the handle base to the door panel, as shown in FIG. 6, a screw locking member 102 to which a screw can be screwed is provided on a rear side (upper side in FIG. 6) of a through hole 101 formed in a handle base 100, and a door panel 5 is sandwiched between the handle base 100 and the screw locking member 102, where the handle base 100 is fixed to the door panel 5 by tightening the screw 103. As an assembling procedure for this structure, before the handle base 100 is assembled to the door panel 5, the screw locking member 102 is, first, temporarily fixed loosely to the handle base 100 with the screw 103 preliminarily, forming one handle base assembly 110. Then, in the assembly line of vehicles, after the screw locking member 102 is inserted into a hole 5*a* formed in the door panel 5, the handle base 100 is moved leftward as viewed in FIG. 6 so that the screw locking member 102 is engaged with an edge of a fixing groove 5*b* communicating with the hole 5*a*, and finally the screw 103 is completely tightened so that the handle base 100 is fixed to the door panel 5. With this structure and assembling procedure, in manufacturing lines for vehicles in which assembling work has to be done within limited time, the step of setting the screw locking member 102 and the screw 103 to the through hole 101 can be omitted, making it possible to achieve the assembly of the door handle device promptly and simply.

However, even when the screw locking member is preparatorily temporarily fixed to the handle base to assemble the handle base assembly as described above, there is a possibility that the screw locking member and the screw may fall off during the work, in which case the assembling work for the handle base assembly would take time in turn.

Also, the worker is necessarily required to pick up screws one by one in the screwing process and tighten the screw while keeping the screw aligned with the screw hole, causing the work to be troublesome.

SUMMARY OF THE INVENTION

Accordingly, an object of the present invention is to provide a door handle device for vehicles capable of preventing falling off of the screw locking member and the screw and improving the assembling workability.

In order to achieve the above object, in a first aspect of the present invention, there is provided a door handle device for vehicles including a handle base to be fixed to a door panel by screwing, wherein the handle base has a through hole for inserting a screw thereinto, and a screw locking member into which a fore end of the screw inserted into the through hole is to be screwed, the screw locking member being formed integrally with the handle base so that the screw locking member can be moved to a position corresponding to the through hole.

With this arrangement, the screw locking member never falls off during the mounting work, making it practicable to assemble the screw locking member to the handle base promptly and simply. Also, since the screw locking member is formed integrally with the handle base, there is no possibility of mis-using screw locking members for any other vehicle types. Further, since there is no need for additionally preparing the screw locking member as a separate member, the parts count can be reduced, contributing to a reduction of man-hours for parts management.

In the door handle device for vehicles according to the first aspect of the invention, the screw locking member may be coupled to a main body of the handle base by a generally thin-plate shaped, elastically deformable coupling portion, and the screw locking member may be placed at a position corresponding to the through hole in such a manner that the coupling portion is bent.

With this arrangement, since movement of the screw locking member in the widthwise direction of the coupling portion is restricted by the generally thin-plate shaped coupling portion, it becomes easier to place the screw locking member at the position corresponding to the through hole. Besides, if the coupling portion is set to such a length that the screw locking member comes to be placed just at the position corresponding to the through hole of the handle base when the coupling portion is bent, the placement of the screw locking member becomes even easier to fulfill.

In the door handle device for vehicles according to the first aspect of the invention, the handle base may have a handle insertion hole to which part of a handle member to be assembled to the handle base is to be fitted, and the screw locking member may be provided within the handle insertion hole or at a position projected from the main body of the handle base.

With this arrangement, if the screw locking member has not yet been temporarily fixed to the handle base, the screw locking member is present within the handle insertion hole or at the position projected from the main body of the handle base. Therefore, whether or not the screw locking member has been temporarily fixed can easily be verified visually from outside. Thus, failure to do the temporary fixation of the screw locking member to the handle base can be prevented with reliability.

In a second aspect of the invention, there is provided a door handle device for vehicles including a handle base to be fixed to a door panel by screwing, the handle base comprising: a through hole for inserting a screw thereinto, a blocking portion for blocking inclination of the screw by making contact with a screw head portion of the screw inserted into the through hole, the blocking portion being provided around one side of the through hole of the handle base on which the screw is inserted, and a restrictive claw portion for restricting movement of the screw in an axial direction by engaging with a screw thread of the screw inserted into the through hole, the restrictive claw portion being provided at the through hole, wherein the screw inserted into the through hole is temporarily fixed to the handle base by the blocking portion and the restrictive claw portion.

With this arrangement, since movement of the screw in an unscrewing direction of the screw is restricted by the restrictive claw portion and moreover the screw is temporarily fixed to the handle base with inclination of the screw restricted by the blocking portion, it never occurs that the screw rattles and falls off during the assembling work. Also, since inclination of the screw is restricted by the blocking portion, there is no need for holding the screw with fingers, allowing an easier positioning of the screw against the object of the tightening of the screw. As a result of this, the assembling work can be achieved promptly and reliably. Moreover, even during the tightening work of the screw, since inclination of the screw is restricted by the blocking portion, tightening faults of the screw can be reduced.

In the door handle device for vehicles according to the second aspect of the invention, the restrictive claw portion may be provided at least two in number on an inner circumference of the through hole so as to be protruded on a skew, each of the restrictive claw portions being elastically deformable in an insertion direction of the screw.

With this arrangement, inserting the screw into the through hole without rotation causes the restrictive claw portions to be elastically deformed along the dips and bumps of the thread of the screw, and stopping the insertion of the screw at an arbitrary position causes the screw to be held within the through hole at the position. Thus, only thrusting the screw into the through hole without rotating the screw allows the screw to be temporarily fixed easily.

In the door handle device for vehicles according to the second aspect of the invention, the door handle device may further comprise a screw locking member into which a fore end of the screw inserted into the through hole is to be screwed, wherein the screw locking member is held at a mounting position by the temporarily fixed screw.

With this arrangement, in the mounting of the handle base to the door panel, there is no need for exerting operation control each time so that the screw locking member comes to the mounting position. As a consequence, the mounting work of the handle base to the door panel can be achieved more promptly.

As described above, with the door handle device for vehicles according to the first aspect of the invention, the screw locking member never falls off, and the screw locking member can be mounted to the handle base easily. Also, by the screw locking member being formed integrally with the handle base, the parts count can be reduced, contributing to a reduction of the man-hours for parts management.

Also, in the door handle device for vehicles according to the second aspect of the invention, the screw never rattles or falls off during the assembling work, and the door handle device can be assembled promptly and reliably.

BRIEF DESCRIPTION OF THE DRAWINGS

The present invention will be further described with reference to the accompanying drawings wherein like reference numerals refer to like parts in the several views, and wherein.

DETAILED DESCRIPTION OF THE INVENTION

Figure 1:
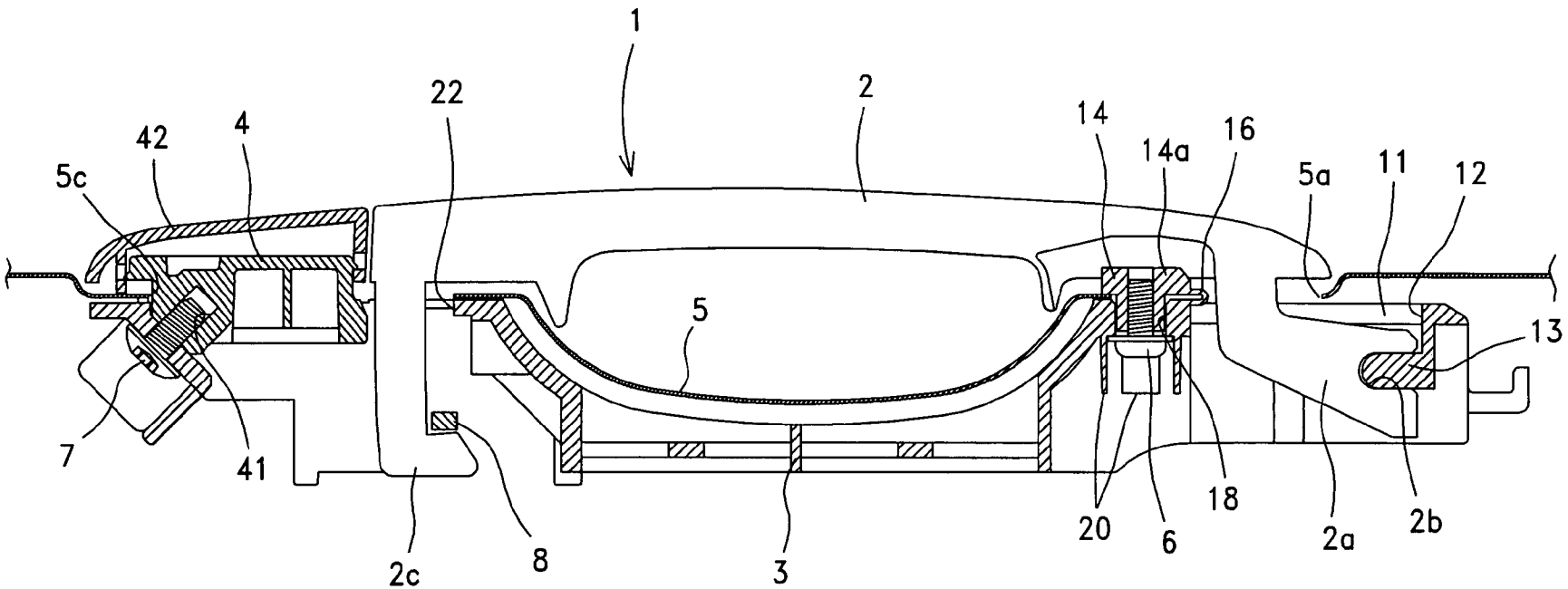
FIG. 1 is a longitudinal sectional view of a door handle device for vehicles.

FIG. 1 is a longitudinal sectional view showing a door handle device 1 for vehicles, which is an embodiment of the invention. This door handle device 1 includes a handle member 2 elongated in a back and forth direction of the vehicle, a handle base 3 for fixing the handle member 2 to a door panel 5 of the vehicle, and an external fitting member 4 to which an unshown cylinder lock or the like is to be fixed.

A generally L-shaped arm portion 2*a* is protrusively provided at an end of the handle member 2, with a shaft insertion groove 2*b* formed at its protruding end. Also, a generally U-shaped protruding portion 2*c* is protrusively provided on a side of the handle member 2 opposite to the side on which the arm portion 2*a* is provided.

Figure 2A:
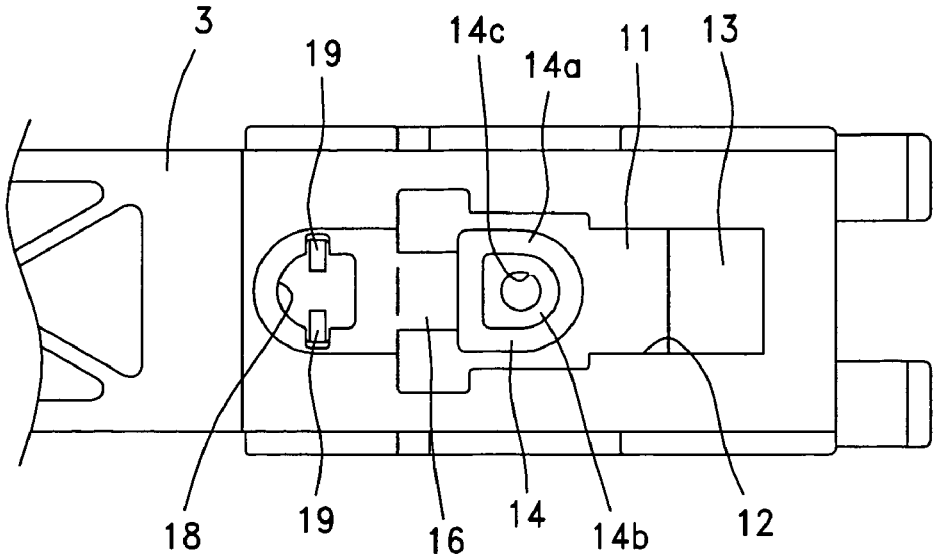
FIG. 2A is a plan view of a main portion of a handle base.
Figure 2B:
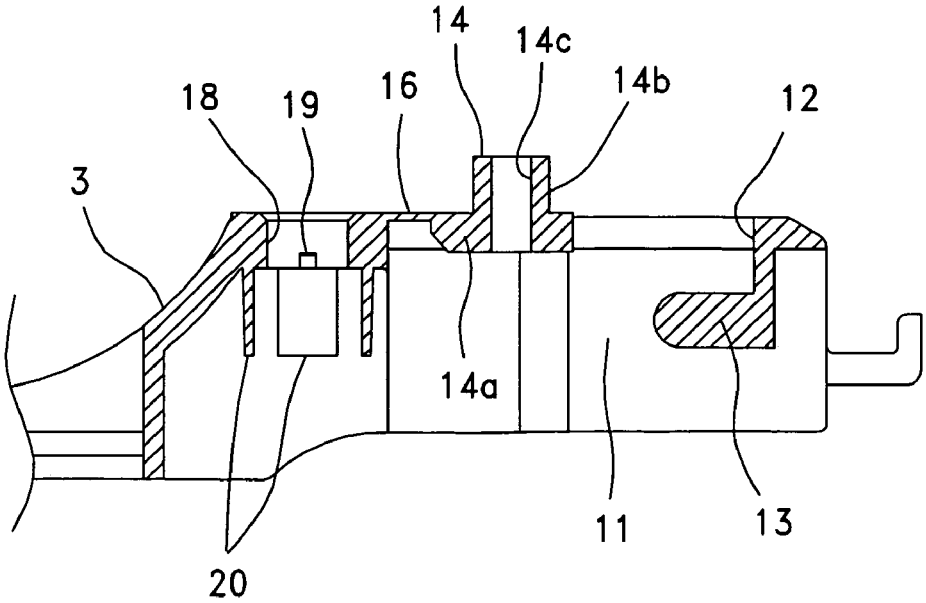
FIG. 2B is a side sectional view of a main portion of the handle base shown in FIG. 2A.

The handle base 3, to which the arm portion 2*a* and the protruding portion 2*c* of the handle member 2 are to be internally fitted, is formed of resin material. Also, the handle base 3 is mounted on an interior-side (lower side in FIG. 1) face of the door panel 5. In this handle base 3, as shown in FIG. 1 and FIGS. 2A and 2B, is formed a handle fitting portion 11 having a handle insertion hole 12 for inserting the arm portion 2*a* of the handle member 2 thereinto. Inside the handle fitting portion 11 is formed a pivotal convex portion 13 which is to be fitted into the shaft insertion groove 2*b* of the arm portion 2*a* of the handle member 2 so that the handle member 2 is rotatably pivoted.

As shown in FIGS. 2A and 2B, a screw locking member 14 that allows a screw to be screwed therewith is provided at a generally central portion of the handle insertion hole 12. The screw locking member 14 is coupled with the main body of the handle base 3 by a coupling portion 16 which extends from an opening edge of the handle insertion hole 12 and which is generally thin-plate shaped and elastically deformable, the screw locking member 14 being formed integrally with the handle base 3. The screw locking member 14, which is generally convex-shaped, is composed of a generally disc-shaped base portion 14*a* and a protruding portion 14*b* protruding from the base portion 14*a* and having a generally semicircular-shaped cross section, where the protruding portion 14*b* is so formed as to be fitted into a later-described through hole 18. Also, inside the screw locking member 14, a screw locking hole 14*c* having an unshown thread groove with which the screw is to be fitted is provided so as to extend through the screw locking member 14 in the protruding direction of the protruding portion 14*b*.

Figure 3:
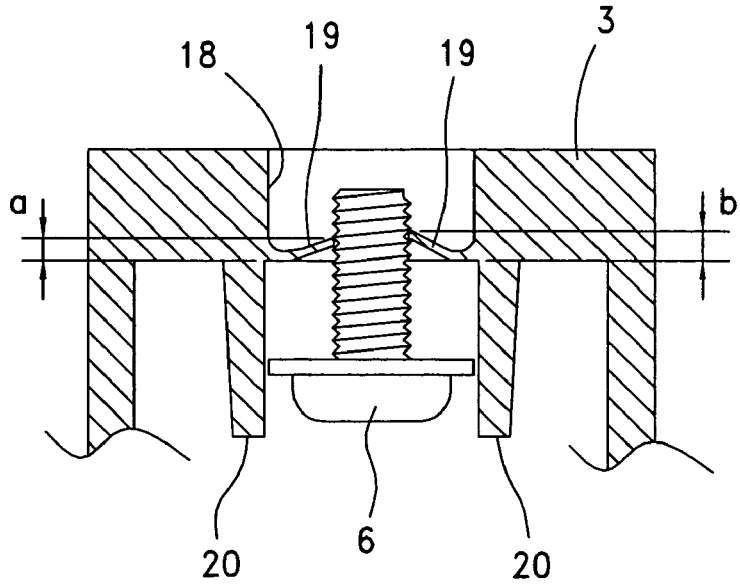
FIG. 3 is a sectional view showing a state in which a screw is temporarily fixed to a through hole.

A through hole 18 through which a screw is to be inserted is formed on the rear side (left side in FIGS. 2A and 2B) of the handle insertion hole 12. At lower end edge portions of the inner circumferential surface of the through hole 18, as shown in FIG. 3, two tongue-like opposed restrictive claw portions 19 are protrusively provided so as to be inclined toward the direction of insertion of a screw 6. These restrictive claw portions 19 are intended to temporarily fix the screw 6, and engagement of their respective fore ends with the thread of the screw 6 makes the screw 6 temporarily fixed to a specified position. Also, these restrictive claw portions 19 are formed integrally with the handle base 3 so as to be elastically deformable, so that inserting the screw 6 into the through hole 18 without rotation causes the restrictive claw portions 19 to be elastically deformed along the dips and bumps of the thread of the screw 6, and stopping the insertion of the screw 6 at an arbitrary position causes the screw 6 to be held within the through hole 18 at the position. It is noted that the restrictive claw portions 19 are not limited to two in number but may be three or more.

These two restrictive claw portions 19 are made different in protrusion height (a, b) from the edge of the through hole 18. As a result of this, when the screw 6 is inserted into the through hole 18, the respective fore ends of the two restrictive claw portions 19 are fitted to the thread at positions shifted from each other by one half pitch (or integrally multiplied pitch+one half pitch) relative to the screw 6. With such a structure, the screw 6 can be held straighter with respect to the axial direction of the through hole 18.

Further, a blocking portion 20 for preventing tilt of the screw head of the screw 6 is provided around one side of the through hole 18 of the handle base 3 on which the screw 6 is inserted. The blocking portion 20, which is placed in such a generally rectangular cylindrical shape as to surround the screw head of the screw 6, is formed of, for example, four flat plates protrusively provided in parallel with the axial direction of the through hole 18.

Referring again to FIG. 1, on the rear end side (left side in FIG. 1) of the handle base 3 is formed a fitting hole 22 for inserting and fitting the protruding portion 2*c* of the handle member 2 and the external fitting member 4. Also, around the fitting hole 22 is formed an unshown claw portion for temporarily fixing the rear end side of the handle base 3 in engagement with the edge of a hole 5*c* of the door panel 5. Further, on the rear end side of the handle base 3, one end portion 8 of the handle lever for actuating an unshown door lock device is provided at a position for engagement with the protruding portion 2*c* of the handle member 2. Then, with a rotating operation that causes the handle member 2 to be pulled out outside the vehicle, the end portion 8 of the handle lever is moved along with the movement of the protruding portion 2*c* of the handle member 2, thereby actuating the door lock device so that the door is unlocked.

The external fitting member 4, which is exemplified by a cylinder base to which an unshown cylinder lock or the like is to be fixed, is mounted at a specified position from the vehicle outside of the door panel 5. In this external fitting member 4, a screw locking portion 41 for screwing a screw 7 is formed. Also, a cover 42 for covering the external fitting member 4 is fitted on the vehicle outside of the external fitting member 4.

Figure 5:
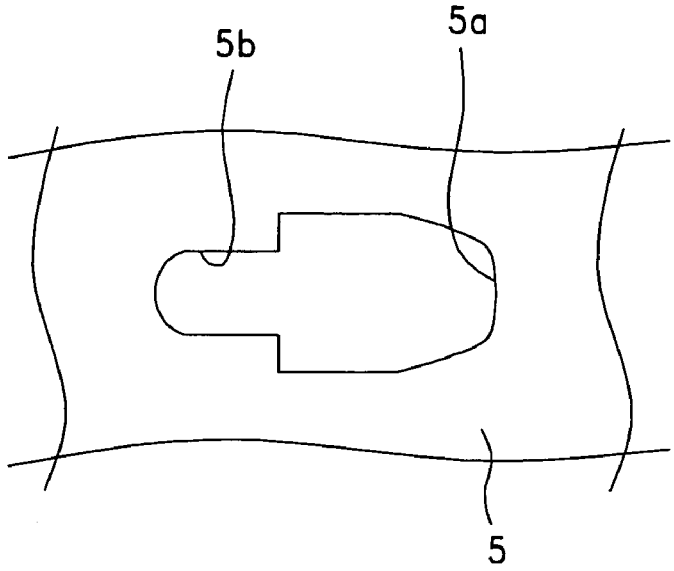
FIG. 5 is a plan view of the hole of the door panel.
Figure 6:
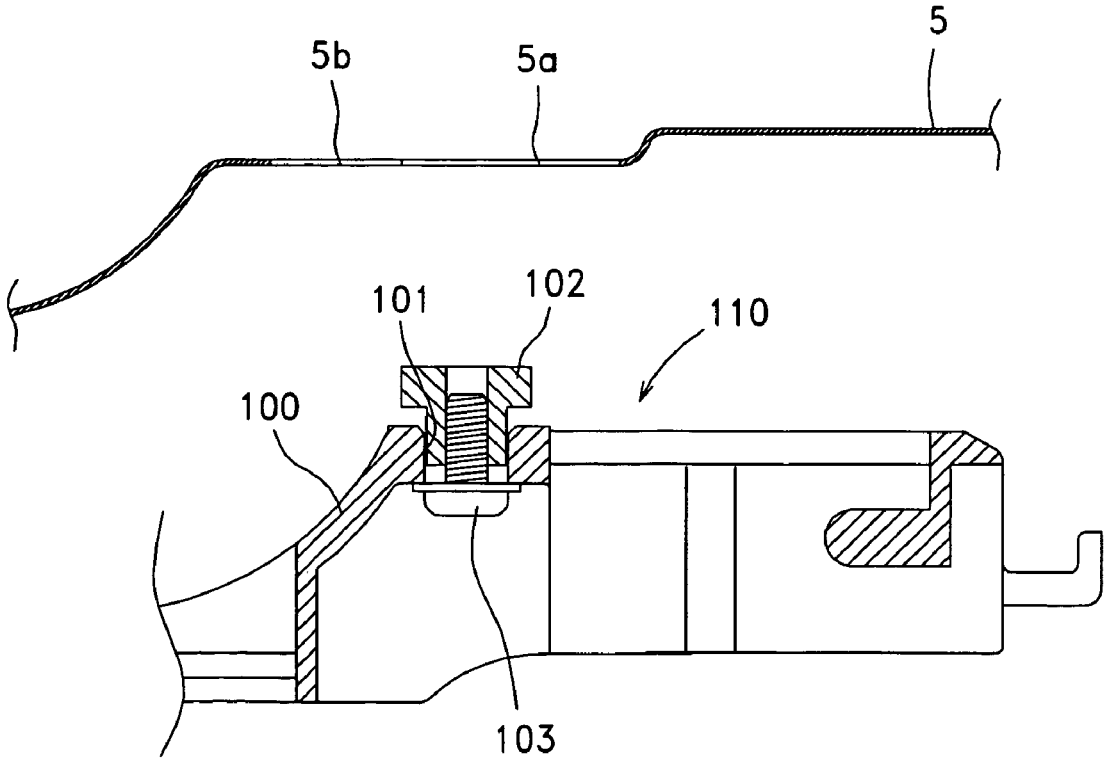
Fig.6 PRIOR ART
FIG. 6 is a longitudinal sectional view of a prior art handle base.

Meanwhile, in the door panel 5, to which the handle base 3 is to be mounted, a hole 5*a* through which the arm portion 2*a* of the handle member 2 is to be inserted, as well as the hole 5*c* for fitting the protruding portion 2*c* of the handle member 2 and the external fitting member 4, are provided at positions corresponding to the handle insertion hole 12 and the fitting hole 22, respectively, of the handle base 3. The hole 5*a*, as shown in FIG. 5, has a fixing groove 5*b* which is smaller in width than the base portion 14*a* of the screw locking member 14 and which is formed so as to communicate with the hole 5*a*.

Next, a procedure for assembling the door handle device 1 for vehicles is explained.

Figure 4:
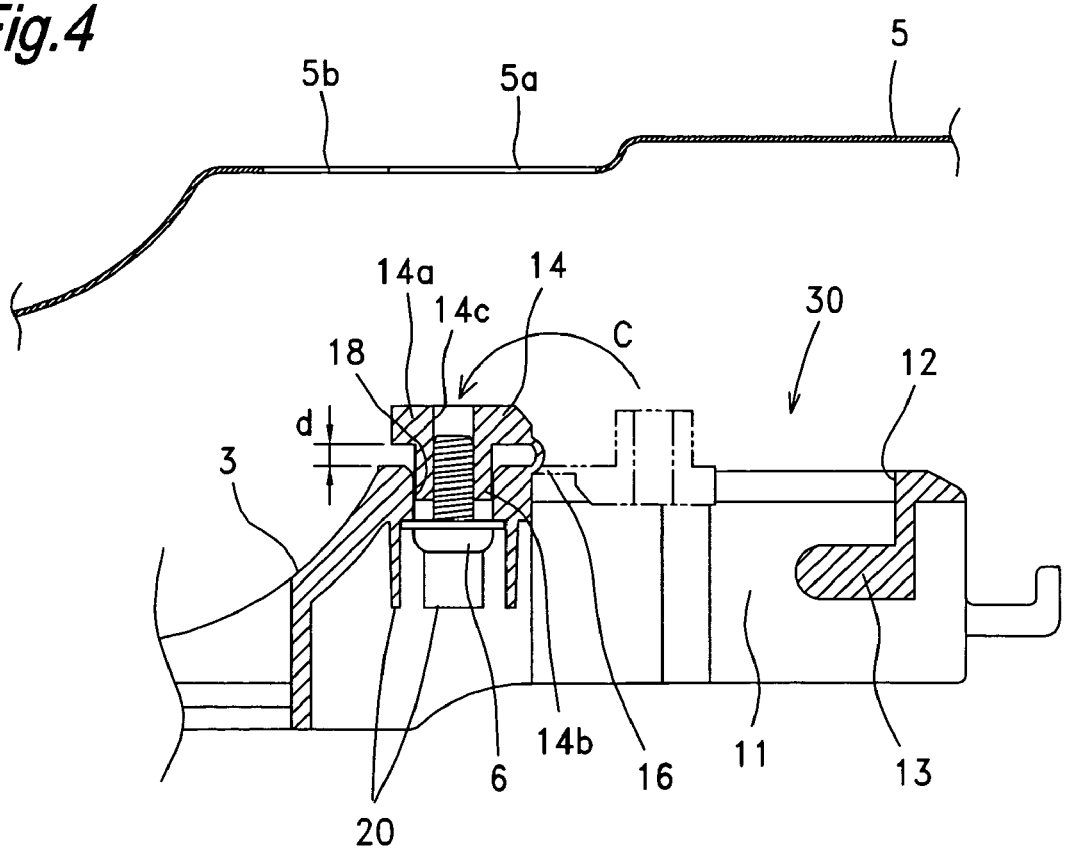
FIG. 4 is a longitudinal sectional view showing a state before the handle base is mounted to a door panel.

First, as the screw 6 is inserted into the through hole 18 of the handle base 3, the screw 6 is held within the through hole 18 by the two restrictive claw portions 19 as described before, and besides the screw 6 is temporarily fixed to the handle base 3 while any inclination of the screw 6 is blocked by the blocking portion 20. Next, as shown in FIG. 4, the coupling portion 16 is rotationally moved so as to be bent in a direction of arrow C. Then, the protruding portion 14*b* of the screw locking member 14 is fitted into the through hole 18. Finally, the temporarily fixed screw 6 is screwed into the screw locking member 14 up to a specified position by a driver or the like, by which the screw locking member 14 is temporarily fixed to the handle base 3, thus completing a handle base assembly 30.

In this case, since the screw locking member 14 is formed integrally with the handle base 3, the screw locking member 14 never falls off during the mounting work, making it practicable to assemble the screw locking member 14 to the handle base 3 promptly and simply. Also, since the screw locking member 14 is formed integrally with the handle base 3, there is no possibility of mis-using screw locking members of any other vehicle types or the like. Further, since there is no need for additionally preparing the screw locking member as a separate member, the parts count can be reduced, contributing to a reduction of the man-hours for parts management.

Also, since movement of the screw locking member 14 in the lateral direction (widthwise direction of the coupling portion 16) is restricted by the generally thin-plate shaped coupling portion 16, it becomes easier to place the screw locking member 14 at a position corresponding to the through hole 18. Besides, if the coupling portion 16 is set to such a length that the screw locking member 14 comes to be placed just at the position corresponding to the through hole 18 of the handle base 3 when the coupling portion 16 is bent, the placement of the screw locking member 14 becomes even easier to fulfill.

Also, if the screw locking member 14 has not yet been temporarily fixed to the handle base 3, the screw locking member 14 is present within the handle insertion hole 12 as indicated by two-dot chain line in FIG. 4. Therefore, whether or not the screw locking member 14 has been temporarily fixed can easily be verified visually from outside. Thus, failure to do the temporary fixation of the screw locking member 14 to the handle base 3 can be prevented with reliability.

Also, in the assembling of this handle base assembly 30, since the screw 6 is held nearly straight so as to be coaxial with the center axis of the screw locking hole 14*c* of the screw locking member 14, there is no need for holding the screw 6 by finger, and the screw can be tightened by only driving the screw as it is with a driver or the like. Besides, even during the tightening work of the screw 6, since inclination of the screw 6 is restricted by the blocking portion 20, the screw 6 is never driven in on the skew, so that tightening faults of the screw 6 can be reduced.

Further, in this handle base assembly 30, even with the screw 6 screwed in the screw locking member 14, movement of the screw 6 in the axial direction is restricted by the restrictive claw portions 19. On this account, the screw locking member 14, into which the screw 6 has been screwed in midway, is held as its movement in the axial direction is restricted against the handle base 3 as well. As a result of this, the screw locking member 14 does not move downward as viewed in FIG. 4, and a gap 'd' which is necessary for mounting to the door panel 5 and wider than the thickness of the door panel 5 and which is shown in FIG. 4 is formed between the base portion 14*a* and the handle base 3, this state being maintained. Therefore, in the mounting of the handle base 3 to the door panel 5, there is no need for exerting operation control each time so that the screw locking member 14 comes to the mounting position where the aforementioned gap 'd' is formed. As a consequence, the mounting work of the handle base 3 to the door panel 5 can be achieved more promptly.

Next, the handle base assembly 30 is placed at a specified position from the vehicle interior side of the door panel 5 on the vehicle assembly line. Then, the base portion 14*a* of the screw locking member 14 of the handle base assembly 30 is inserted into the hole 5*a* of the door panel 5, and slid toward the fixing groove 5*b*. As a result, the door panel 5 enters into the gap 'd' between the base portion 14*a* of the screw locking member 14 and the handle base 3 main body, so that the base portion 14*a* of the screw locking member 14 is engaged with the edge of the fixing groove 5*b*. Besides, the unshown claw portions on the rear end side of the handle base 3 are also engaged with the edge of the hole 5*c* of the door panel 5 because of the slide. Then, completely tightening the screw 6 causes the handle base 3 to be fixed to the door panel 5.

Next, the handle member 2 is assembled to the handle base 3 from the vehicle exterior of the door panel 5. More specifically, the arm portion 2*a* of the handle member 2 is inserted into the handle insertion hole 12 of the handle base 3 via the hole 5*a* of the door panel 5, and the shaft insertion groove 2*b* of the handle member 2 is fitted into the pivotal convex portion 13 of the handle base 3. Then, the protruding portion 2*c* of the handle member 2 is inserted into the fitting hole 22 of the handle base 3 via the hole 5*c* of the door panel 5, and the protruding portion 2*c* is engaged with one end portion 8 of the handle lever, by which the handle member 2 is assembled to the handle base 3.

Finally, the external fitting member 4 is fitted to the fitting hole 22 of the handle base 3 from the vehicle exterior side of the door panel 5, and the screw 7 is tightened to the screw locking portion 41, by which the rear end side of the handle base 3 is fixed to the door panel 5. Thus, the assembling of the door handle device 1 is completed.

As described above, in the door handle device for vehicles according to this embodiment, the screw locking member 14 can be mounted to the handle base 3 easily while the screw locking member 14 is prevented from falling off. Also, by forming the screw locking member 14 integrally with the handle base 3, the parts count can be reduced, contributing to a reduction of the man-hours for parts management.

Furthermore, according to the door handle device 1 of this embodiment, it never occurs that the screw 6 rattles and falls off during the assembling work, so that the door handle device 1 can be assembled promptly and reliably.

In this embodiment, the screw locking member 14 is so placed as to be positioned at the opening portion of the handle insertion hole 12 of the handle base 3 in a before-operation state. However, this is not limitative, and the screw locking member 14 may also be placed so as to be positioned within the fitting hole 22 of the handle base 3 in the case of, for example, a door handle device of the type that the through hole 18 for screwing is provided near the fitting hole 22 of the handle base 3. Also, the screw locking member 14 does not necessarily need to be within the handle insertion hole 12 in a before-operation state, and for example, the screw locking member 14 may be formed so as to be erected upward in FIG. 4, having only to be so positioned that the screw locking member 14 can be visually seen easily from the exterior.

Furthermore, although the two restrictive claw portions 19 are provided with a difference of one half pitch in protrusion height from each other in this embodiment, this is not limitative and, for example, the two restrictive claw portions 19 may be formed equal in protrusion height to each other. In this case also, since inclination of the screw 6 is blocked by the blocking portion 20, it never occurs that the screw 6 is held with a more than specified inclination. Also, the screw 6 does not necessarily need to be held completely straight with respect to the center axis of the through hole 18, and the restriction of inclination of the screw 6 may be such that the screw 6 can be tightened without holding the screw 6 with fingers.

Although the present invention has been fully described by way of examples with reference to the accompanying drawings, it is to be noted that various changes and modifications will be apparent to those skilled in the art. Therefore, unless such changes and modifications otherwise depart from the scope of the present invention, they should be construed as being included therein.

What is claimed is:

1. A door handle device for vehicles including a handle base to be fixed to a door panel by screwing, wherein the handle base has a through hole for inserting a screw thereinto, and a screw locking member into which a fore end of the screw inserted into the through hole is to be screwed, the screw locking member being formed integrally with the handle base so that the screw locking member can be moved to a position corresponding to the through hole, wherein the screw locking member is coupled to a main body of the handle base by an elastically bendable coupling portion, and wherein the screw locking member and the elastically bendable coupling portion are arranged such that the coupling portion can be bent to move the screw locking member into a position in which a portion of the screw locking member is disposed in the through hole of the handle base.

2. The door handle device for vehicles as claimed in claim 1, wherein the screw locking member is coupled to a main body of the handle base by a generally thin-plate shaped, elastically deformable coupling portion, and the screw locking member is placed at a position corresponding to the through hole in such a manner that the coupling portion is bent.

3. The door handle device for vehicles as claimed in claim 1, wherein the handle base has a handle insertion hole to which part of a handle member to be assembled to the handle base is to be fitted, and the screw locking member is provided within the handle insertion hole or at a position projected from the main body of the handle base.

4. The door handle device for vehicles as claimed in claim 1, wherein the screw locking member has a threaded through hole formed therein into which the screw is to be threaded.

5. The door handle device for vehicles as claimed in claim 1, wherein the through hole of the handle base and the screw locking member are arranged such that the screw locking member, when moved to the position corresponding to the through hole, is disposed on an exterior side of the handle base and can receive a leading end of the screw when the screw is inserted into the through hole from an interior side of the handle base.

6. A door handle device for vehicles including a handle base to be fixed to a door panel by screwing, the handle base comprising: a through hole for inserting a screw thereinto, a blocking portion for blocking inclination of the screw by making contact with an outer periphery of a screw head portion of the screw inserted into the through hole, the blocking portion being provided around one side of the through hole of the handle base on which the screw is inserted, and a restrictive claw portion for restricting movement of the screw in an axial direction by engaging with a screw thread of the screw inserted into the through hole, the restrictive claw portion being provided at the through hole, wherein the screw inserted into the through hole is temporarily fixed to the handle base by the blocking portion and the restrictive claw portion, wherein the blocking portion protrudes from the handle base so as to at least partially surround an opening of an insertion end of the through hole, wherein the blocking portion comprises at least two blocking members disposed on diametrically opposite sides of the opening of the insertion end of the through hole so as to face each other and so as to be arranged to engage diametrically opposite portions of the outer periphery of the screw head portion of the screw, and wherein the two blocking members disposed on the diametrically opposite sides of the opening of the insertion end of the through hole are spaced apart by a distance greater than an inner diameter of the opening of the insertion end of the through hole.

7. The door handle device as claimed in claim 6, wherein the restrictive claw portion comprises at least two restrictive claw members on an inner circumference of the through hole so each of the restrictive claw members being elastically deformable in an insertion direction of the screw.

8. The door handle device for vehicles as claimed in claim 6, further comprising a screw locking member into which a fore end of the screw inserted into the through hole is to be screwed, wherein the screw locking member is held at a mounting position by the temporarily fixed screw.

9. The door handle device for vehicles as claimed in claim 6, wherein the restrictive claw portion is elastically deformable and protrudes inwardly into the through hole.

10. The door handle device for vehicles as claimed in claim 9, wherein the elastically deformable restrictive claw portion is inclined toward an insertion end of the through hole so as to yieldingly engage the screw thread of the screw upon insertion of the screw into the through hole without requiring rotation of the screw.

11. The door handle device for vehicles as claimed in claim 10, wherein the restrictive claw portion comprises at least two restrictive claw members protruding toward each other.

* * * * *